United States Patent [19]

McCarty

[11] 4,045,975

[45] Sept. 6, 1977

[54] COMBINATION MOTOR COOLER AND STORAGE COIL FOR HEAT PUMP

[75] Inventor: William J. McCarty, Louisville, Ky.

[73] Assignee: General Electric Company, Louisville, Ky.

[21] Appl. No.: 713,438

[22] Filed: Aug. 11, 1976

[51] Int. Cl.[2] ..... F25B 41/00

[52] U.S. Cl. ..... 62/196 B; 62/324; 62/505

[58] Field of Search ..... 62/174, 196 B, 324, 62/505

[56] References Cited

U.S. PATENT DOCUMENTS

| | | | |
|---|---|---|---|
| 2,959,937 | 11/1960 | Coyne | 62/324 |
| 2,967,410 | 1/1960 | Schulze | 62/505 |
| 3,006,162 | 10/1961 | Massa | 62/324 |
| 3,006,163 | 10/1961 | Kooiker | 62/324 |
| 3,006,164 | 10/1961 | McMillan | 62/324 |
| 3,105,633 | 10/1963 | Dellario | 62/505 |
| 3,109,297 | 11/1963 | Rinehart | 62/505 |
| 3,110,164 | 11/1963 | Smith | 62/324 |
| 3,276,221 | 10/1966 | Crumley | 62/505 |

*Primary Examiner*—Ronald C. Capossela
*Attorney, Agent, or Firm*—Frank P. Giacalone; Francis H. Boos

[57] ABSTRACT

The present invention relates to a reversible refrigeration system providing a combination of cooling the hermetic motor of the system during the cooling cycle of the system by injecting a portion of refrigerant from the system into the discharge flow of the compressor and storing portion of the refrigerant during the heating cycle.

4 Claims, 2 Drawing Figures

COMBINATION MOTOR COOLER AND STORAGE COIL FOR HEAT PUMP

BACKGROUND OF THE INVENTION

1. Field of the Invention

The present invention relates to a heat pump refrigeration system employing a hermetic motor compressor wherein compressed refrigerant passes over the motor prior to being discharged into the system, and more particularly, to an automatic valved system for providing injection cooling of the compressed refrigerant discharged from the compressor prior to its passage over the motor when the system is operating in the cooling cycle.The valved system further provides for the storage of excess refrigerant when the refrigeration system is operating in the heating cycle.

2. Description of the Prior Art

The present invention is employed in conjunction with a hermetic motor compressor of the type disclosed in U.S. Pat. Nos. 2,967,410—Schulze and 3,006,164—McMillan, both being assigned to the General Electric Company, assignee of the present invention. Both of the above patents disclose means for cooling the motor to maintain its temperature within safe operating limits. The method of motor cooling employed is to pass the high pressure discharge gas from the compressor unit over the motor after this high pressure gas has been cooled to a low enough temperature to remove heat from the motor.

The discharge gas may be cooled by passing it through a superheat removal coil which is connected to the discharge outlet of the compressor unit and extends outside the hermetic casing into the outside ambient and then back to the casing as disclosed in U.S. Pat. No. 3,006,164. Another method used incorporates the injection of refrigerant from the refrigeration system into the casing where it mixes with the discharge gas to cool it prior to its passinng over the motor as disclosed in U.S. Pat. No. 2,967,410. Means are also provided for automatically increasing and decreasing the amount of refrigerant added to the case according to the load on the motor so that the amount of cooling will vary correspondingly with the varying loads on the compressor and thereby maintain the motor continuously at a safe operating temperature. The means for varying the amount of refrigerant injected in the discharge flow may, as provided in both of the above patents, be an aspirating device arranged in the compressor discharge passageway.

It has been recognized in the art that optimum operation of heat pumps on the cooling cycle, i.e., when the indoor heat exchanger is being used as an evaporator, requires a greater effective charge of refrigerant than that required for operation of the heating cycle, when the indor coil is functioning as the condenser. Accordingly, many attempts have been made to solve this problem. U.S. Pat. No. 3,110,164—Smith discloses one of the prior art systems emloyed for accumulating a portion of the refrigerant charge during the heating cycle and for restoring the accumulated portion of the charge to the system during the cooling cycle.

SUMMARY OF THE INVENTION

By this invention there is provided a reversible refrigeration system adapted for heating and cooling, including a motor compressor unit, an indoor heat exchanger and an outdoor heat exchanger connected in reversible refrigerant flow relationship. The system typically includes a valve for reversing the flow of refrigerant to operate each of said heat exchangers interchangeably as a condensor or as an evaporator. The motor compressor unit is mounted in a hermetically sealed casing adapted to contain a high pressure refrigerant gas received from a discharge passage leading from said compressor. An aspirator positioned in the discharge passage creates a low pressure region in the discharge gas stream as it passes through the aspirator. Refrigerant from the system is ducted to the aspirator by a conduit which has its other end connected at some point between the reversing valve and the outdoor coil.

Located in the conduit is a one way refrigerant pressure responsive valve that is operable when the outdoor coil is operating as a condenser due to higher refrigerant pressure being present on the condenser side of the one way valve relative to the pressure on the aspirator side thereof. The valve operation and design, permits a regulated portion of refrigerant flow to enter the conduit and be injected by action of the aspirator into the compressed refrigerant flow passing through the discharge passage so that the temperature of the compressed discharge refrigerant entering the casing is lowered.

Located in the conduit between the one way valve and the aspirator is a storge coil which receives a regulated portion of the compressed refrigerant when the outdoor coil is operating as an evaporator due to a higher refrigerant pressure being present on the aspirator side of the one way valve relative to the pressure on the evaporator side. This differential in pressure is effective in forcing the compressed refrigerant into the storage coil during the heating cycle and for maintaining the valve in its closed position.

DESCRIPTION OF THE PREFERRED EMBODIMENT

Figures 1, 2:
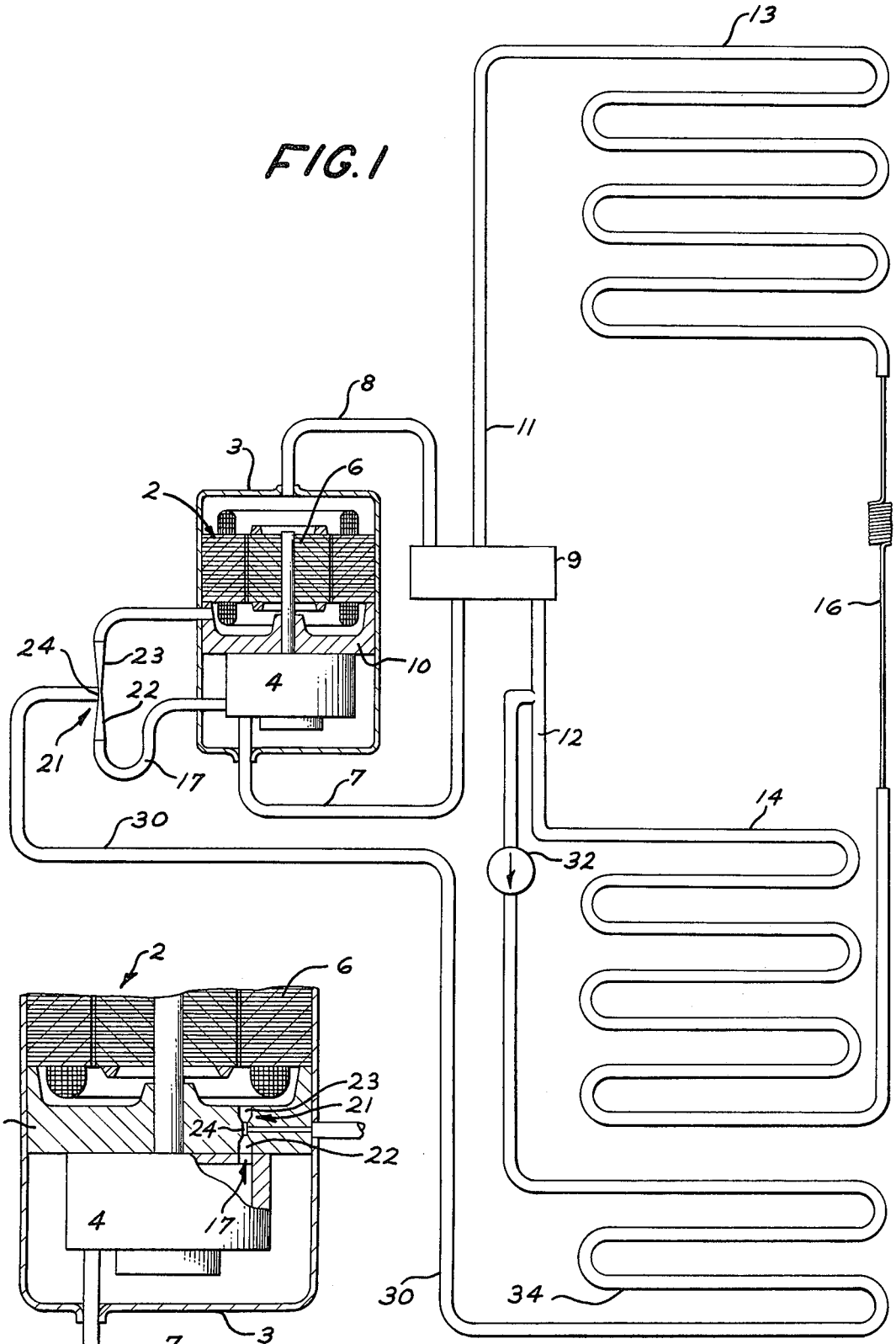
FIG. 1 is a schematic diagram of a reversible cycle refrigeration system incorporating the present invention.
FIG. 2 is a fragmentary elevational cross section of a compressor showing a second embodiment of the invention.

Referring now to the drawings, there is shown a reversible cycle refrigeration system for use in an air conditioner of the type adapted to both heat and cool the air of an enclosure. For compressing and pumping refrigerant through the system there is provided a motor compressor unit, generally designated by the numeral 2. The motor compressor 2 is mounted in a hermetically sealed casing 3 which houses the compressor 4 and its drive motor 6 and which is suitable for containing a high pressure refrigerant gas. A suction line 7 connects directly to or with the suction inlet (not shown) of the compressor and carries low pressure refrigerant gas to the compressor. A discharge line 8 is connected to the case for carrying the high pressure gas from within the case into the remaining portions of the system. The discharge line and suction line are both connected to a reversing valve 9. Also connected to the reversing valve 9 are a pair of conduits 11 and 12 which lead respectively to the indoor and outdoor heat exchangers or coils 13 and 14. Included in the system for the purpose of expanding refrigerant from condensing pressure to evaporator pressure is a capillary expansion means 16. This capillary 16 operates as an expansion means during both cooling and heating cycles and maintains a predetermined pressure differential between the evaporator and the condenser regardless of the direction of refrigerant flow.

In an air conditioning unit of this type, the indoor coil 13 is arranged for heating or cooling air from the enclosure, while the outdoor coil 14 is arranged for either rejecting heat to or extracting heat from the outside atmosphere. The reversing valve 9 is selectively reversible to direct discharge gas into either one of the lines 11 and 12 while receiving low pressure gas from theother line, thereby making this system reversible for either heating or cooling an enclosure. Thus, if it is desirable to set this system on the heating cycle, compressor discharge gas flowing through the discharge line 8 is connected by means of the reversing valve 9 to the line 11 which carries the hot discharge gas to the indoor coil 13. This coil then acts as a condenser to give up its heat to the enclosure. If it is desired to set the system for cooling the enclosure the suction line 7 is connected to the indoor coil 13 through line 11 which then acts as an evaporator, while the discharge gas is carried to the outdoor coil 14 by the line 12.

During operation of the compressor, low pressure refrigerant, entering the compressor unit 4 from the suction line 7 is compressed within the compressor unit to a relatively high pressure and temperature and is then discharged by the compressor. During normal operation high pressure gas flows from the compressor 4 through a suitable discharge conduit 17 where the high pressure gas is partially cooled. The passage 17 discharges the high pressure gas into the case below the motor 6, and, after flowing upwardly over the motor 6, the high pressure gas is conducted out of the casing 3 though conduit 8 into the remaining portions of the system. The discharge passage 17 could be a passage which leads from the discharge port of the compressor unit 4 directly through a main frame 10 of the unit into the hermetic casing 3 without leaving the hermetic casing as shown in FIG. 2 and further disclosed in the above cited U.S. Pat. No. 2,967,410—Schulze.

Included within the discharge passage 17 is an aspirating means or a venturi section generally designated by the reference numeral 21, through which hot discharge gas passes prior to entering the hermetic case. The passage 17 discharges the high pressure gas into the case below the motor 6 whereupon it flows upwardly over the motor to cool the motor. The high pressure gas is then conducted out of the casing 3 through the conduit 8 into the remaining portion of the system. Alternatively, when the discharge passage is in the frame 10 the aspirating means will accordingly be located therein.

Typically, in air conditioning systems, whether of the window or split system type, the compressor is usually located in the outdoor cabinet. When the system is operating in the heating cycle, the outdoor ambient temperature is usually cold enough to maintain the temperature of the compressor motor within design operating limits. In effect, when the heat pump system is in the heating mode to provide heat to an area, the compressor arranged in the colder outdoor ambient does not require motor cooling. On the other hand, during the cooling operation, the ambient temperature is generally too high to offer significant motor compressor cooling and, accordingly, compressor motor cooling may be required.

By the present invention, means are provided whereby motor cooling is effective only during the cooling cycle of the heat pump system wherein the outdoor coil 14 is operating as the condenser.

In order to cool the discharge gas flowing through the discharge passage sufficiently to maintain the motor within safe operating temperatures, cool liquid refrigerant is introduced into the high pressure discharge stream as it flows through the passage 17. As may be seen in the drawing, the aspirating means contains a nozzle or gas accelerating section 22 and a diffuser or gas deceleration section 23 separated by a pinched or throat portion 24.

Liquid refrigerant is supplied to the passageway 17 and more particularly, in the area 24 of the aspirating means 21 from a point in the system between the reversing valve 9 and the outdoor heat exchanger 14 through a conduit 30. When liquid refrigerant is introduced into the throat or low pressure region 24 of the aspirating means 21, it encounters the relative hot discharge gas and is vaporized or flashed into a gaseous form. Heat removed from the discharge gas is vaporizing the liquid refrigerant reduces the temperature of the discharge gas and the violent reaction created by the flashing of the liquid into vaporized form completely mixes the gas so that the resultant gas mixture issuing from the passage is at a uniform temperature and much cooler than the temperature of the original high pressure gas discharged from the compressor.

In the cooling mode, the refrigerant entering outdoor coil or, in this instance, condenser 14, is at approximately 295 PSI while the pressure im conduit 30 is approximately 290 PSI. This difference in pressure causes a valve 32 arranged in conduit 30 to open so that during the cooling cycle refrigerant is bled from the system at approximately the pressure and temperature it enters the coil 14 which is operating as the condenser. Means are provided to cool the refrigerant passing through valve 32. To this end a coil 34 is arranged between valve 32 and aspirator 21 so that refrigerant entering conduit 30 passes through coil 34 which in effect partially condenses and cools the refrigerant passing therethrough. This relatively cooler refrigerant is conducted through conduit 30 to the discharge passageway 17 in amounts sufficient to lower the temperature of the discharge gas so as to maintain the motor temperature within design limits as it passes therethrough.

When the system is in the heat pump mode and the coil 14 is operating as the evaporator, the flow of refrigerant from the evaporator 14 to the valve 9 is at approximately 30 PSI pressure, while the refrigerant in line 30 is at 240 PSI, which will maintain the valve 32 in its closed position and, accordingly, prevent flow in either direction therethrough, and motor cooling does not take place.

Generally, an overcharge of refrigerant results when the unit is switched over from the cooling to the heating cycle. This is attributable to the fact that a lower range of outdoor temperatures coming into contact with the outdoor coil 14 produces a lower pressure level in the outdoor coil, resulting in refrigerant being delivered to the motor compressor with a lower specific gravity. In this situation, the motor compressor pumps refrigerant through the circuit at a lower rate, weightwise, and, at the same time, the larger pressure difference between the indoor and outdoor coils tends to increase the rate of refrigerant flow through the capillary 16. As a result, the indoor coil 13 has a reduced level of liquid refrigerant and the outdoor coil 14 contains an excessive quantity of liquid refrigerant; and sometimes liquid refrigerant floods through the suction line.

In accordance with the present invention, means are provided in conjunction with the motor cooling system that is operable during the cooling cycle to store refrigerant during the heating cycle. To this end, the storage coil 34 which is arranged in conduit 30 and between valve 32 and passageway 17 serves as a storage coil when the system is operating in the heating cycle.

In the heat pump cycle, the pressure differentials in the system as explained above are effective in maintaining the valve 32 closed. The discharge gas will then enter line 30 and will continue to bleed through the aspirator 21 until the storage coil 34 is filled with refrigerant. The refrigerant will remain in line 30 and storage coil 34 during the time the system is in the heat mode. It should be understood that the volume and size of the conduit 30 and storage coil 34 may be chosen by one skilled in the art to store the proper amount of refrigerant relative to the system requirements. To increase the efficiency of the storage coil 34, it is located in the ambient air flow through coil 14.

The conduit 30 and storage coil 34 is purged automatically when the system is switched to the cooling cycle. At that time, the valve 32 opens as explained hereinabove and all of the refrigerant stored in conduit 30 and storage coil 34 re-enters the refrigeration system through the passageway 17 and aspirator 21.

In summary, by the present invention, there is provided a system wherein motor cooling is provided during the cooling cycle when the compressor is operating in a relatively hot environment while automatically valving to provide refrigerant storage when the system is operating in the heating cycle. A return to the cooling cycle once again automatically valves to purge the stored refrigerant back into the system.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A reversible refrigeration system adapted for heating and cooling, a motor compressor unit, an indoor heat exchanger and an outdoor heat exchanger connected in reversible refrigerant flow relationship, means connected between said heat exchangers for expanding refrigerant from condensor pressure to evaporator pressure, a valve for reversing the flow of refrigerant through said system to operate said system in a heating or cooling mode with each of said heat exchangers arranged interchangeably as a condenser or as an evaporator, said motor compressor unit being mounted in a hermitically sealed casing for containing a high pressure refrigerant gas, a discharge passage leading from said compressor into said casing for conducting compressed refrigerant from said compressor into said casing, aspirating means in said discharge passage for creating a low pressure region in said discharge gas stream as it passes through said aspirating means, wherein the improvement comprises:

a conduit having one end connected at some point between said reversing valve and said outdoor coil and having its other end connected to said aspirating means;

a one-way refrigerant pressure responsive valve arranged in said conduit being operable when said outdoor coil is operating as a condenser due to higher refrigerant pressure being present on the condenser side of said one-way valve relative to the pressure on the aspirator side thereof for permitting a regulated portion of refrigerant flow to enter said conduit and be injected by action of said aspirating means into said compressed refrigerant passing through said discharge passage to lower the temperature of said compressed discharge refrigerant entering said casing.

2. The refrigeration system according to claim 1 wherein:

a storage coil is arranged in said conduit between said one-way valve and said aspirating means for receiving a regulated portion of said compressed refrigerant through said aspirating means when said outdoor coil is operating as an evaporator due to a higher refrigerant pressure being present on the aspirator side of said one-way valve relative to the pressure on the evaporator side, said pressure differential being effective in forcing said compressed refrigerant into said storage coil during the heating mode and for maintaining said one-way valve in its closed position.

3. The refrigeration system according to claim 2 wherein:

said discharge passageway is a tube leading from said compressor including a portion arranged out of said hermetic casing and then leading back into said casing, said aspirating means being arranged in the portion of said tube located out of said casing.

4. The refrigeration system according to claim 2 wherein:

said discharge passageway including said aspirating means is located in said hermetic casing between the motor and compressor of said motor compressor unit.

* * * * *